US005110131A

United States Patent [19]

Long

[11] Patent Number: 5,110,131

[45] Date of Patent: May 5, 1992

[54] POSITIVE DRAFT GOLF IRON

[76] Inventor: D. Clayton Long, 3707 Gateway, Albany, Ga. 31707

[21] Appl. No.: 646,161

[22] Filed: Jan. 25, 1991

[51] Int. Cl.[5] ..... A63B 53/04

[52] U.S. Cl. ..... 273/167 H; 273/169; 273/77 A; 273/162 R

[58] Field of Search ..... 273/167 A, 169, 167 F, 273/80 C, 167 H, 164, 183 D, 167 E, 170, 171, 172, 175, 162 R, 77 A; D21/220

[56] References Cited

U.S. PATENT DOCUMENTS

| | | | |
|---|---|---|---|
| D. 93,862 | 11/1934 | Barnhart | D21/214 |
| D. 208,058 | 7/1967 | Johnston | D21/214 |
| 1,532,545 | 4/1925 | Pedersen | 273/164 |
| 1,582,836 | 4/1926 | Link | 273/167 H |
| 2,447,967 | 8/1948 | Stone | 273/77 R |
| 3,035,839 | 5/1962 | Coglianese | 273/167 A X |
| 3,059,926 | 10/1962 | Johnstone | 273/77 R |
| 3,655,188 | 4/1972 | Solheim | 273/80 C |
| 3,897,065 | 7/1975 | Solheim | 273/167 A |
| 4,621,813 | 11/1986 | Solheim | 273/77 A |

*Primary Examiner*—George J. Marlo
*Attorney, Agent, or Firm*—Jones, Askew & Lunsford

[57] ABSTRACT

A golf iron head comprising a heel, a toe, a sole, a planar striking face, a backside, a top, a center of mass, and a hosel for connecting to a shaft, wherein the angle formed by the planar striking face and the face of the toe is greater than 90 degrees, the toe side of the club between the striking face and the backside extending back and outwardly away from the heel to a barkside point outermost from the center of mass (compared longitudinally).

3 Claims, 3 Drawing Sheets

POSITIVE DRAFT GOLF IRON

TECHNICAL FIELD

The present invention relates generally to golf clubs. More particularly, the present invention relates to a golf iron having a positive draft toe.

BACKGROUND OF THE INVENTION

Golf clubs, particularly golf irons, comprise a head with a hosel and a shaft which is attached to the head by fitting the shaft into a bore in the hosel. The hosel is attached to and integral with the head. The head includes a heel, a bottom sole, a toe, a planar striking face, and a backside. The head of a conventional golf iron has a longitudinal length heel-to-toe substantially greater than the width between the striking face and the backside. On the other hand, woods generally have a relatively low length-to-width ratio. Also, the toe side of the striking face in a conventional golf iron is higher than the heel side of the striking face. This keeps the center of gravity in the center of the blade.

Golf irons typically include a set of eleven irons, numbered one (long) through nine (short), a pitching wedge, and a sand wedge. The eleven irons of a set conventionally have varying degrees of loft angle and lie angle. The loft angle of an iron is the angle between a vertical plane which includes the shaft, and the plane of the striking face of the iron. The lie angle of an iron is the angle between the shaft and the ground (horizontal plane) when the tangent to the sole directly under the center of mass is in the horizontal plane and when the shaft lies in a vertical plane.

The loft angle, as the name suggests, determines how much loft is imparted to the ball when it is struck by the tilted striking face. The lie angle of the iron assures that, when the golf club is swung properly, the sole of the iron will contact the ground evenly so that the striking face will not tend to twist inwardly or outwardly.

The toe defines a side face on the head between the striking face and the backside. The side face in an iron extends generally back and toward the heel. The face of the toe in top view thus defines a curvilinear line between the striking face and the backside. This is known as negative draft. The outermost point on the toe (compared longitudinally with respect to the center of mass) is typically at or near the edge between the toe and the striking face. The toe in known negative draft golf irons generally extends no further away longitudinally from the center of mass than a line perpendicular to the plane of the striking face and tangent to the outermost point on the edge between the toe and the striking face. For example, the edge on some irons is beveled and this results in the outermost point being on the outside edge of the bevel.

In another aspect of a negative draft golf iron, a straight line approximates the face of the toe and is defined by passing a horizontal plane through the head. Two points on the plane define the line. The first point is the intersection of the plane with the toe edge of the striking face. The second point is the intersection of the plane with the toe edge of the backside. These two points in the horizontal plane define the imaginary line across the side face. The line across the side face and the plane of the striking face together form an angle which is 90° or less. In known negative draft golf irons, the outermost point on the toe is at or near the edge between the toe and the striking face.

For example, U.S. Pat. No. 1,532,545 illustrates a golf club head with negative draft in which the length-to-width ratio is substantially high. As shown in FIG. 3 of the '545 patent, the toe face tapers back from the planar portion of the striking face toward the heel of the club. Generally, the negative draft design facilitates casting of the head and removal of the head from a mold.

U.S. Pat. No. 2,447,967 describes a negative draft golf club head in which the length-to-width ratio is relatively low. The toe face tapers back and toward the heel at an angle of 90° or less.

U.S. Pat. No. 1,582,836 describes a metallic golf wood head with a convex toe. The head is hollow and includes an abutment behind the striking face to provide strength and to provide offset and take up the shock from hitting a golf ball. A counterweight is cast into the rear portion of the head. This head, as with solid heads, places the mass of the club primarily behind the head. The amount of mass on the toe does not significantly impact the performance of the club.

U.S. Pat. No. 3,035,839 describes a multipurpose golf club which has a length-to-width ratio between those of conventional woods and irons. As with the wood described above, the toe is convex. The head is provided with a first sole surface on an outer toe portion and a second sole surface on a heel portion. The first sole surface intersects the striking face at a first acute angle. The second sole surface intersects the striking face at a second larger acute angle. With the second sole surface resting on the ground, the striking face has a substantial amount of lift. With the first sole surface, the pitch of the striking face is reduced. Depending on which sole surface is positioned on the ground, the club can be used for long putts and chip shots or relatively short putts. The weight of the head is concentrated toward its heel end to aid the player in making relatively long shots.

With many known golf clubs, it is desirable to hit a golf ball on the "sweet spot" or in line with the center of mass of the club. Golf balls hit with such centered shots have truer flights and travel longer distances than off-center shots. Hitting the ball slightly off-center on the striking face creates problems with the control of the direction and flight of the golf ball. The golf club tends to twist and vibrate, which absorbs the striking energy of the golf swing. The twisting and vibration impart undesirable spin to the golf ball as it leaves the striking face. Spin causes the ball to hook or to slice. The ball does not travel in the direction desired by the golfer nor does the ball travel as far as it would for a solid, on-center shot. A golf club with a larger sweet spot on the striking face helps compensate for an off-center shot by a golfer. Generally, a club with a larger sweet spot has an increased mass moment of inertia about the center of mass. The effect of an increased mass moment of inertia is a reduction of the twisting and other vibrational forms of energy loss experienced from a shot hit on the striking face at a point other than the center of mass.

There are several known methods of increasing the mass moment of inertia for a golf club. These methods include increasing the weight of the club and re-distributing the weight of the club. However, increasing the mass moment of inertia of a golf club head is restricted by a number of factors that relate to the playability requirements for a golf club. Increasing the weight of the club is not always possible nor desirable.

For example, the total mass of the club head is determined by the shaft length, the grip weight, and the desired swing weight. Increasing the mass of the head may result in a heavier than desired swing weight. A golf club which is too heavy cannot be swung with a proper stroke. This results in off-center shots, loss of control, and shorter flights of the golf ball.

Another method of increasing the mass moment of inertia concentrates the majority of the club weight at the heel and the toe. Such a design reduces the golf club's tendency to twist when the golf ball is hit off-center. In a golf iron, such weight distribution is accomplished by providing a cavity in the back of the head of the golf club. The mass removed from the cavity of the club is placed around the perimeter of the backside and concentrated at the heel and the toe.

U.S. Pat. No. 4,621,813 describes a set of golf irons having such a cavity back. The material which would otherwise be in the cavity is redistributed in the heel and toe. The redistributed material improves the resistance to twisting of the club head upon off-center impact with a golf ball. Further, these golf irons have negative draft toes.

U.S. Pat. No. 3,059,926 describes a golf iron having an increased moment of inertia. A plug of material is added on the backside near the toe. This club also is a negative draft golf iron with the toe face forming an angle of 90° or less with the striking face.

However, other playability requirements also affect the distribution of mass in the golf club. These include the length and shape of the sole of the club and its contact area with the ground during a golf swing or shot. For instance, a blade with a longer length has its mass positioned farther from the center of mass. But a longer length blade has an increased sole length and this results in significantly higher ground drag. High ground drag means that the club is dragging on the ground during the shot. This may result in a slower club speed during the stroke through the golf ball and in a decreased flight distance for the golf ball. Also, a longer leading edge may inhibit the taking of a proper divot.

Thus, there exists a need in the art for a golf iron having an increased moment of inertia without the loss of desirable club dimensional and playability characteristics.

SUMMARY OF THE PRESENT INVENTION

The present invention solves the needs described above by providing a golf iron head with a positive draft toe. The golf iron head of the present invention provides a higher mass moment of inertia than that previously obtainable with a negative draft iron of the same weight, while retaining the critical dimensional and playability characteristics of a golf iron.

Generally described, the golf iron head of the present invention consists of a heel and a toe, a sole, a planar striking face, a backside with an open cavity for perimeter weighting, a top, a center of mass, and a hosel for connecting to a shaft, wherein the angle formed by the planar striking face and the face of the toe is greater than 90 degrees.

More particularly described, the toe of the club defines a side between the toe edge of the striking face and the toe edge of the backside of the club. The toe tapers back from the striking face and outward away from the heel. The golf iron of the present invention therefore is a positive draft club because the face of the toe is oriented in a reverse direction from that in a negative draft golf club. In top view the toe may be approximated as a horizontal line between a first point on the toe edge of the striking face and a second point on the toe, which second point is outermost from the center of mass (compared longitudinally). This line forms an angle with the plane of the striking face. This angle in the positive draft golf head is greater than 90 degrees. The second point is spaced-apart from the edge between the toe and the striking face. In a preferred positive draft embodiment, the second point is at the opposite side near the edge between the toe and the backside.

The toe in a golf club head according to the present invention extends back and outward away from the heel. The sole sweeps upward at an angle into the toe. This aspect of the present invention therefore provides a golf club with a sole having dimensional and playability characteristics similar to that for traditional negative draft golf clubs. The present invention eliminates the problems associated with increased ground drag that would be expected in a golf club having a longer blade.

Accordingly, it is an object of the present invention to provide a golf iron having an increased moment of inertia.

It is another object of the present invention to provide a cavity back golf iron with increased moment of inertia.

It is another object of the present invention to provide a golf iron which is easily manufactured.

It is another object of the present invention to provide a golf iron which has a positive draft toe.

It is another object of the present invention to provide a golf iron with a positive angle of draft at the toe.

It is another object of the present invention to provide a golf iron with a positive draft toe to increase the moment of inertia over that of a same weight golf iron having a negative draft toe.

Other objects, features and advantages of the present invention will become apparent upon reading the following detailed description of the disclosed embodiment of the present invention, in conjunction with the appended drawings and claims.

DETAILED DESCRIPTION OF THE PREFERRED EMBODIMENT

Figure 1:
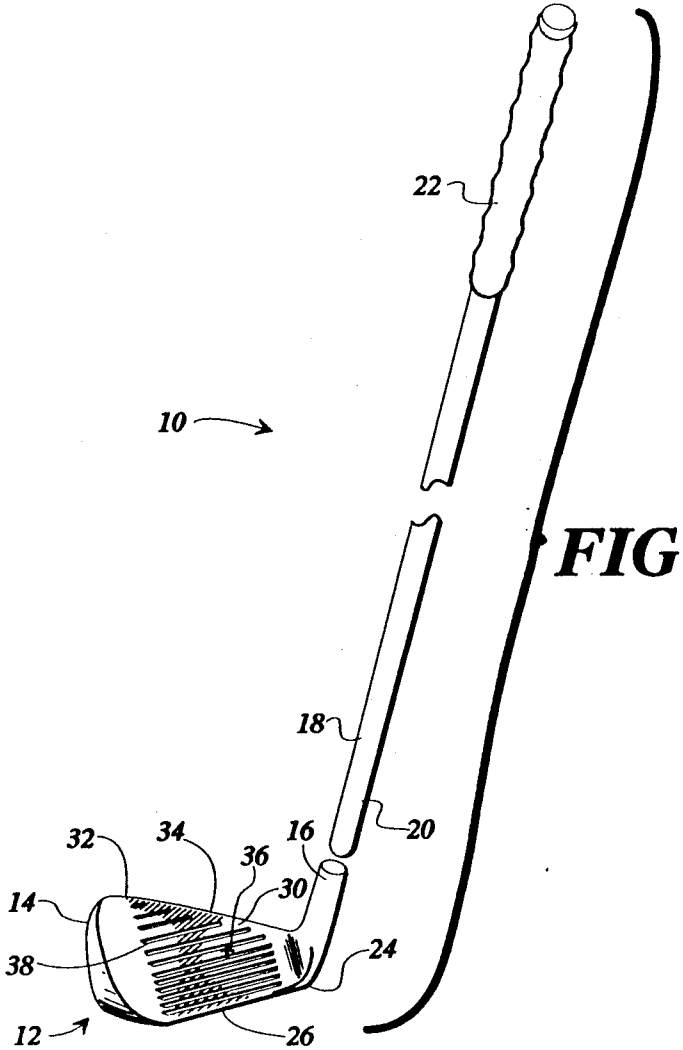
FIG. 1 is a perspective view of a golf iron having a head with positive draft, in accordance with the present invention.

Referring now in more detail to the drawings, in which the same parts have like identifiers, FIG. 1 is a perspective view of a golf iron 10 comprising a head 12 with a positive draft toe 14, a hosel 16, and a shaft 18. The hosel 16 is attached to and integral with the head 12. The lower end 20 of the shaft 18 is fitted into a bore of the hosel 16. A grip 22 is secured to the upper end of the shaft 18.

The head 12 comprises a heel 24, the positive draft toe 14, a bottom sole 26, a planar striking face 30, a backside 32 with an open cavity 33 for perimeter weighting, a top 34, a center of mass 36, and the hosel 16. A plurality of grooves 38 are formed on the striking face 30, as is well known in the art.

Figure 2:
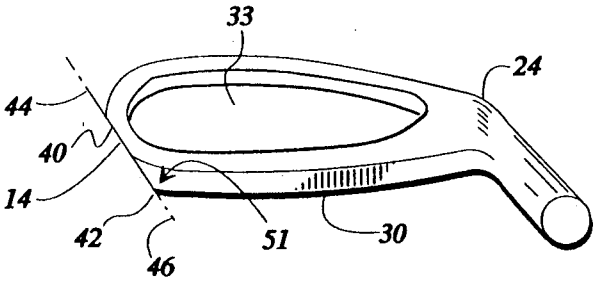
FIG. 2 is a top view of the golf iron head shown in FIG. 1.
Figure 3:
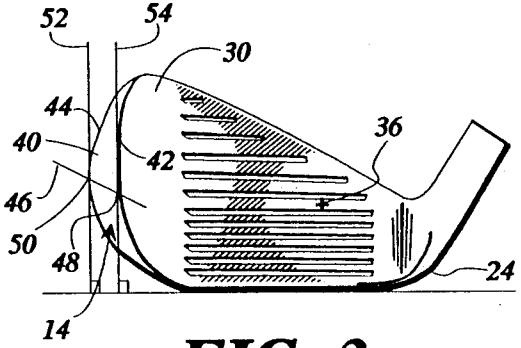
FIG. 3 is a front view of the golf iron head shown in FIG. 1.

FIGS. 2 and 3 further illustrate the golf head 12 of the present invention. FIG. 2 is a top view of the golf club head 12 rotated forward so the plane of the striking face 30 is shown as a horizontal line. FIG. 3 is a front view of the golf club head 12. The positive draft toe 14 defines a side face 40 of the head 12. The side face 40 extends between a toe edge 42 of the striking face 30 to a toe edge 44 of the backside 32. The side face 40 tapers back from the striking face 30 and outward away from the heel 24. A horizontal line 46 is defined by a first point 48 on the toe edge 42 and a second point 50 on the toe edge 44. This second point is the outermost point of the toe longitudinally from the center of mass 36. The line 46 forms an angle 51 with the striking face 30, which is greater than 90 degrees.

This structure of the golf club head 12 may be further described by defining a first line 52 perpendicular to a ground line 58 and tangent to the outermost point on the side face 40. A second line 54 is defined perpendicular to the ground line 58 and tangent to the outermost point on the striking face. The line 52 is farther (measured longitudinally) from the center of mass 36 than is the line 54. In the embodiment illustrated in FIG. 1, the outermost point on the side face 40 is on the toe edge 44 of the backside 32.

Figure 5:
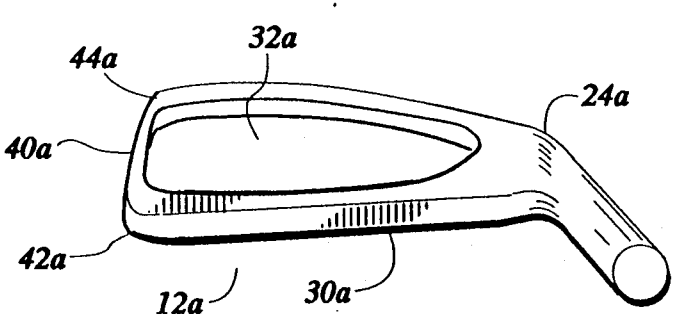
FIG 5 (PRIOR ART)
FIG. 5 is a top view of a prior art golf iron head with negative draft.
Figure 6:
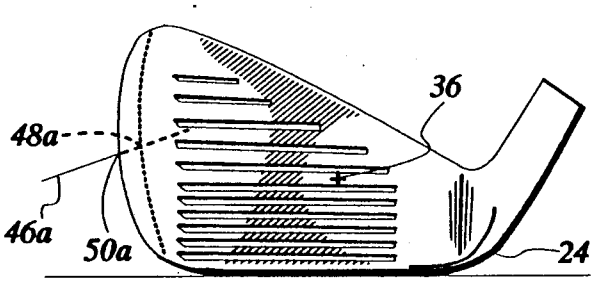
FIG 6 (PRIOR ART)
FIG. 6 is a front view of the prior art golf iron head shown in FIG. 5.

A prior art golf head **12*a* is illustrated in top view in FIG. 5 and in front view in FIG. 6. The view in FIG. 5 is the same as the view in FIG. 2 where the golf head is rotated forward. The plane of the striking face is shown as a horizontal line. The toe face 40*a* extends between the toe edge 42*a* of the striking face 30*a* and the toe edge 44*a* of the backside 32*a*. The toe face 40*a* tapers back and inward toward the heel 24*a*. The horizontal line 46*a* approximating the toe face 40*a* is defined by two points. The first point 48*a* is on the toe edge 42*a* and the second point 50*a* is on the toe edge 44*a*. The line 46*a* forms an angle with the plane of striking face 30*a*, which is 90 degrees or less. The point 42*a* is farther from the center of mass compared longitudinally than is the point 44*a***.

Figure 4:
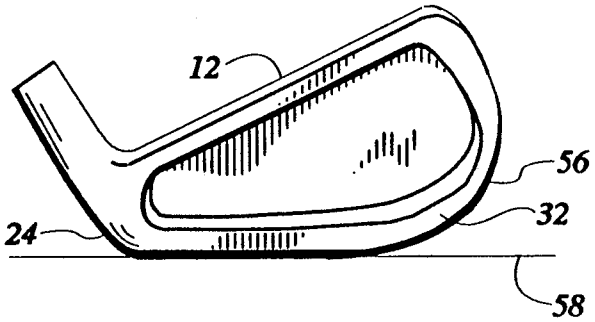
FIG. 4 is a back view of the golf iron head shown in FIG. 1.

With reference to FIG. 4, the toe 14 of the golf club head 12 illustrated in FIG. 1 extends back and outward from the heel 14. The sole 26 is joined to the toe 14 by a tapered up-sweep 56. The up-sweep 56 under the toe 14 rises away from the ground line 58. The up-sweep 56 provides the golf club 10 with a sole 26 having dimensional and playability characteristics similar to that for negative draft golf clubs of the same weight. Thus, problems associated with increased ground drag expected in golf clubs having a longer striking blade are reduced or overcome in the golf club head of the present invention.

Figure 7:
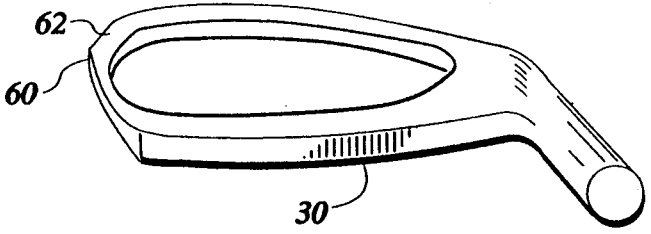
FIG. 7 is a top view of an alternate embodiment of a golf iron head with positive draft.
Figure 8:
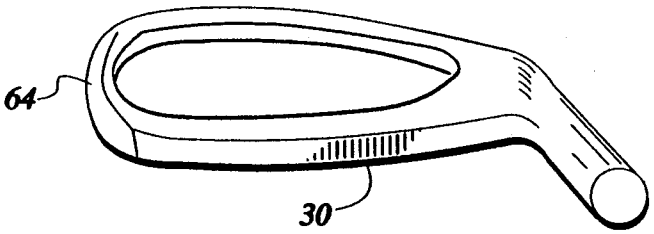
FIG. 8 is a top view of an alternate embodiment of a golf iron head with positive draft.
Figure 9:
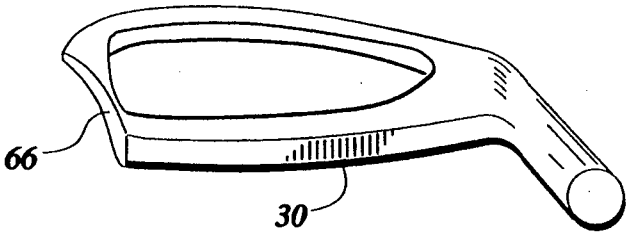
FIG. 9 is a top view of an alternate embodiment of a golf iron head with positive draft.
Figure 10:
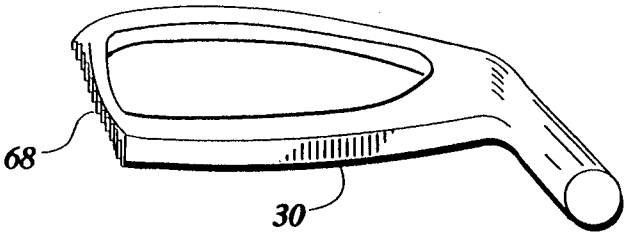
FIG. 10 is a top view of an alternate embodiment of a golf iron head with positive draft.
Figure 11:
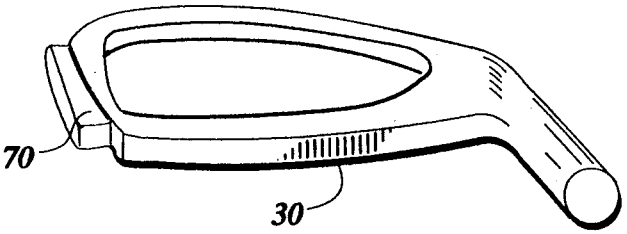
FIG. 11 is a top view of an alternate embodiment of a golf iron head with positive draft.

FIGS. 7–11 illustrate top views of alternate embodiments of a golf iron head with positive draft in which the side face 40 is configured differently. As with FIGS. 2 and 5, the illustrated golf iron heads are rotated forward so that the plane of the striking face 30 is a horizontal line. The illustrated golf iron heads would have increased mass movement of inertia over a similar negative draft club of the same weight. FIG. 7 illustrates a beveled positive draft golf iron head. The side face 40 reaches an outermost point 60 which is spaced-apart from the striking face about two thirds of the width of the head. The side face 40 then extends back toward the heel of the head to define a bevel face 62. It is expected that the effect of the beveled positive draft is slightly reduced in comparison with the full positive draft head illustrated in FIG. 1. However, the beveled positive draft is especially preferred because the bevel face 62 provides the head with an appearance similar to a traditional negative draft golf iron. FIG. 8 illustrates a positive draft golf iron head with a convex side face 64. FIG. 9 illustrates a positive draft golf iron head with a concave side face 66. FIG. 10 illustrates as positive draft golf iron head with a stepped side face 68. FIG. 11 illustrates yet another embodiment of a positive draft golf iron head with a block side face 70 on the toe 14. Other embodiments of the positive draft golf iron heads can be designed.

The positive draft golf irons in the embodiments illustrated in FIGS. 1, 7, 8, 9 and 10 have smoothly tapered surfaces on the head, especially on the toe and sole. This facilitates the grinding and polishing on belts during the finishing steps of the manufacturing process. Further, the tapered surfaces facilitate removal of the cast club from molds, as is known in the art.

A set of positive draft golf irons as shown by the golf iron illustrated in FIG. 1 were manufactured by casting. Such processes are well known in the art for the manufacture of golf clubs. Table 1 below reports the head weight in grams and the positive draft angle, the loft angle, and the lie angle in degrees for the set of golf irons. The positive draft angle is the angle between the face of the toe and the striking face, as described above.

TABLE 1

| | | Positive Draft Irons | | |
|---|---|---|---|---|
| Club No. | Head Weight | Positive Draft Angle | Loft | Lie |
| 1 | 235.9 | 109 | 16 | 57 |
| 2 | 240.9 | 106 | 18 | 57.5 |
| 3 | 246.2 | 106 | 21 | 58 |
| 4 | 254.7 | 106 | 24 | 59 |
| 5 | 266.6 | 110 | 27.5 | 60 |
| 6 | 271.2 | 110 | 31 | 60.5 |
| 7 | 273.7 | 110 | 36 | 61 |
| 8 | 281.1 | 110 | 40 | 61.5 |
| 9 | 293.1 | 110 | 44 | 62 |
| P | 300.2 | 110 | 48 | 63 |
| S | 313.6 | 110 | 56 | 63 |

The positive draft golf irons described above were weighted and fitted to shafts for testing. The mass moment of inertia of each club was determined using a machine which uniformly swings a golf club. Thus, one club may be compared with another.

The golf iron heads were then machined to remove the positive draft toe. The resulting golf heads had negative drafts, as discussed above. Each of the golf heads were weighed to determine the weight of the removed material. This amount of weight was added to the periphery of each club on the backside using lead. The golf heads were again tested to determine the mass moment of inertia for a negative draft golf club having the same weight as the positive draft golf club. The results are shown below in Table 2. The weights are reported in grams (gm); the mass moments of inertia are reported in grams centimeter second squared (gm cm sec2).

TABLE 2

| Mass Moment of Inertia Positive Draft Golf Irons Compared to Traditional Negative Draft Irons | | | | | |
|---|---|---|---|---|---|
| Club No. | Head Weight | Pos. Draft Inertia | Traditional Inertia | Diff. | % Inertia Increase |
| 1 | 235.9 | 2670 | 2380 | 290 | 12.2% |
| 2 | 240.9 | 2680 | 2350 | 330 | 14.0% |
| 3 | 246.2 | 2710 | 2390 | 320 | 13.4% |
| 4 | 254.7 | 2670 | 2360 | 310 | 13.1% |
| 5 | 266.6 | 2690 | 2410 | 280 | 11.6% |
| 6 | 271.2 | 2740 | 2440 | 300 | 12.3% |
| 7 | 273.7 | 2690 | 2430 | 260 | 10.7% |
| 8 | 281.1 | 2720 | 2470 | 250 | 10.1% |
| 9 | 293.1 | 2830 | 2610 | 220 | 8.4% |
| P | 300.2 | 3040 | 2720 | 320 | 11.7% |
| S | 313.6 | 3300 | 3030 | 270 | 8.9% |

The average increase in the mass moment of inertia was 286 grams centimeters second squared. This is an average 11.5% increase for a positive draft golf iron over a traditional negative draft golf iron of the same weight.

Accordingly, the present invention provides a golf iron with a positive draft toe which increases the mass moment of inertia of the club around the center of gravity. This decreases the club's reaction to off-center shots and results in truer flight for the golf ball. The present invention is not limited to the disclosed embodiment of a golf club iron, but is advantageously applied to golf putters.

The principles, preferred embodiments and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. A golf iron head comprising of a heel, a toe, a sole, a planar striking face, a backside, a top, a center of mass, and a hosel for connecting with a shaft, wherein said toe tapers back from said striking face outward away from said heel to a back edge defined by said toe and said back side, wherein said back edge is the outermost portion of said toe from the center of mass.

2. The golf iron head as recited in claim 1, wherein an angle between said striking face and a line between said back edge and a front edge defined by said toe and said striking face is between about 106 and 110 degrees.

3. The golf iron head as recited on claim 2, wherein said iron head has a cavity back.

* * * * *